United States Patent [19]

Davis

[11] Patent Number: 4,801,925

[45] Date of Patent: Jan. 31, 1989

[54] ALARM TRANSMISSION SYSTEM AND CIRCUIT INTERCEPTION SWITCH

[76] Inventor: Albert F. Davis, 2148 W. Washburn, Chicago, Ill. 60608

[21] Appl. No.: 9,459

[22] Filed: Feb. 2, 1987

[51] Int. Cl.[4] ..... G08B 13/00

[52] U.S. Cl. ..... 340/574; 455/100

[58] Field of Search ..... 340/574, 526, 309.15, 340/407, 311.1, 539; 455/100; 128/32–33; 200/1 B

[56] References Cited

U.S. PATENT DOCUMENTS

| | | | |
|---|---|---|---|
| 3,758,733 | 9/1973 | Durocher et al. | 200/1 B X |
| 4,121,160 | 10/1978 | Cataldo | 455/100 X |
| 4,157,540 | 6/1979 | Oros | 340/574 X |
| 4,227,189 | 10/1980 | Davis | 340/574 X |
| 4,300,129 | 11/1981 | Cataldo | 340/574 X |
| 4,352,091 | 9/1982 | Yamasaki | 340/407 X |
| 4,370,602 | 1/1983 | Jones, Jr. et al. | 128/33 X |
| 4,520,351 | 5/1985 | Altman et al. | 340/574 |

FOREIGN PATENT DOCUMENTS

| | | | |
|---|---|---|---|
| 2019625 | 10/1979 | United Kingdom | 340/574 |
| 2102607 | 2/1983 | United Kingdom | 340/574 |

*Primary Examiner*—Glen R. Swann, III
*Assistant Examiner*—Thomas J. Mullen, Jr.
*Attorney, Agent, or Firm*—Joan I. Norek

[57] ABSTRACT

The invention is a circuit interception switch for an alarm transmission system, and an alarm transmission system having an alarm activating switch, a signal transmitter, and a circuit interception switch interposed therebetween, which alarm transmission system requires two closures of the alarm activating switch for energization of the signal transmitter, the first such closure energizing a device warning the user of such closure so that the system can be reset if such first closure was unintentional.

21 Claims, 3 Drawing Sheets

ALARM TRANSMISSION SYSTEM AND CIRCUIT INTERCEPTION SWITCH

TECHNICAL FIELD OF THE INVENTION

The present invention is in the technical field of emergency alarm transmission systems, particularly such systems having as its ultimate component a device capable of transmitting warning radio signals to a remote receptor. More particularly the present invention is in the technical field of such systems that are designed to be worn concealed on the body of the user and activated by unobvious body movement.

BACKGROUND OF THE INVENTION

Emergency alarm systems that transmit warning signals to a remote receptor are generally well known and useful for summoning assistance. Those of the type that are worn concealed on the body of a person and activated by unobvious body movement are often used to alert guards or law enforcement officers of apparent criminal activity, the system permitting a person to send warning signals without detection although under casual, or possibly intense, observation. Further, when the alarm transmission system is wholly portable and worn concealed on the body of the user, it is available for use at any location and does not restrict the user's mobility. In contrast to stationary installations which require manual operation of a switch or the like, such as might be used behind a counter in a store or bank, wholly portable systems concealed on the user's body are far more suitable for use by persons engaged in mobile security duties, such as security guards patrolling extensive premises and the like.

Portable alarm activating systems that are worn on the body and activated by such body movement as chest cavity expansion upon a large intake of air or arm movement, such as the devices disclosed in U.S. Pat. Nos. 2,135,476 and 3,440,635, have the disadvantageous features of requiring a possibly observable movement which could even be physically impossible in some circumstances, which movement is not so unrelated to normal activity to minimize the possibility of an unintentional false alarm transmission. False alarms of any type have a destructive impact on any emergency organization regardless of whether it is public service or a privately maintained operation. The assistance resources are activated for both true and false alarms, diluting these resources and/or requiring the maintenance of a far more extensive assistance operative than otherwise necessary. If false alarms occur with significant frequency, the performance of the assistance resources could well deteriorate as personnel react to an alarm half-heartedly, suspecting that their assistance will be unnecessary.

Public service organizations, such as fire departments and police emergency networks, must attempt to differentiate between true and false emergencies to the extent possible, and when not possible, respond to every alarm without cynicism if they are to provide the services needed by the community, even though many false alarms received are intentional pranks. In private organizations and security systems connected to public service systems such as law enforcement facilities, false alarms are most often unintentional triggering of alarm devices. Nonetheless the impact of such false alarms have a like destructive effect on assistance resources and may create a reluctance in public service system to permit a direct remote connection between them and private security alarms. Hence private organizations must then provide an intermediate support system to determine whether a given alarm from the field is true or false. Such intermediate support systems add to the cost of security maintenance and in situations requiring prompt intervention of public servants, such as police officers, unduly delay the required assistance.

The potential for unintentional transmission of false alarms is diminished with the use of alarm activating devices that are controlled by a body's voluntary movement of the type that is seldom, if ever, performed without forethought. Such a device, disclosed in U.S. Pat. No. 4,227,189, is one mounted on and worn behind a belt or similar structure and includes a switch held in the open, or off, position by the outward pressure of the body it is pressed against. Such pressure is removed by stomach muscle contraction, releasing pressure means, such as springs or the like, that move a first electric contact to a second electric contact thus closing an electrical circuit connected to an alarm transmitter, such as a radio transmitter. While this device significantly diminishes the possibility of unintentional generation of a false alarm signal, while providing a wholly portable, concealed alarm transmission system that is activated by movement not easily detectable by an observer and not normally restricted even if the body is physically bound or the person is under duress not to move, the potential for a false alarm is not reduced to zero. If for any reason the stomach muscles are contracted in the absence of a situation warranting an alarm, the circuit has been closed activating signal transmission. Further, although the device disclosed in U.S. Pat. No. 4,227,189 preferably includes a switching cord easily disengaged from the transmitter so that the activating switch can be rendered nonfunctional when a person is putting it on or taking it off, this disengagement could be overlooked, particularly when the device is being removed, and upon release of the outward pressure of the body on the device, the circuit closes and the transmitter is activated.

Hence it would be desirable to provide a means for preventing an alarm transmission system from transmitting a signal unintentionally, even if the system otherwise has a low potential for such error. It would be desirable to provide a means warning the user that a movement normally sufficient to initiate signal transmission has occurred and providing the user with a mechanism for disengaging the system prior to actual signal transmission. To maintain the secrecy of the device under emergency situations, such warning means must, like the device itself and the activating movement, be not readily detectable to an observer, while the disengagement mechanism, to be used when no emergency exists, need not be so concealed. Such means preferably should not obstruct or delay the transmission when needed.

In U.S. Pat. No. 4,157,540 there is disclosed a wireless alarm system having a portable wireless transmitter assembly, the components of which can be mounted on a belt. The assembly includes a normally-open contact switch closed upon stomach muscle distension. This assembly does include a warning means comprising an electromagnetic vibrator that imparts a tingling sensation to the wearer when activated. The vibrator may be connected to the activating switch directly or through a timer. In either of two embodiments upon switch closure the timer activates the vibrator and then, after a predetermined time period, the transmitter. Upon an unintentional activation, the user must interrupt the alarm sequence before transmitter activation. Hence to be effective in precluding false alarms there must be a sufficient time delay between vibrator activation and transmitter activation for the user to respond to the warning and take the action necessary to interrupt the sequence. This patent suggests a delay interval of five or ten seconds, and the smaller this safety interval, the less effective is the timer means in preventing false alarms. Inherent in such system, however, is the inability of the user to override the safety means and avoid the delay in signal transmission. Thus the speed at which an alarm can be sounded at a remote receptor has in part been sacrificed to provide a means for interrupting what otherwise would be false alarms. In many emergency situations, in particular life threatening situations, the addition of 5 or 10 seconds to the response time could be a critical deficiency in the security operation.

U.S. Pat. No. 4,300,129 discloses an alarm device mounted within a belt buckle that is activated by stomach distension, which movement pulls a sliding element out of a housing against opposing spring force. The sliding element has a series of detent notches along its side(s) that engage detent followers to restrict movement to a series of discrete legs as opposed to a continuous movement. In this patent a warning system is attributed to the element's movement from one notch to the other; such movement changes belt tension which, when noticed by the wearer, warns of the device's activation. Signal transmission occurs only upon the element reaching a predetermined notch; prior to that time the element can be reset back into its original position. In such a device the warning means, belt tension loosening, is not such a distinct or abrupt sensation as a vibrator or the like and hence could go unnoticed by the wearer, particularly if separated from the body with one or more layers of clothing, which would be normal for a belt worn in customary fashion, or if the user is distracted or subjected to vibration such as in or on a moving apparatus or vehicle. Moreover again if the device is set so as to sufficiently delay signal transmission to permit the sequence to be interrupted and the device reset, time delay between encountering an emergency and actual signal transmission is necessarily created.

It is an object of the present invention to provide a means that prevents transmission of an unintentional alarm signal with an alarm transmission system, particularly with an alarm transmission system of the type that is wholly portable and designed to be worn concealed on the body of the user. It is an object to provide such a means for such an alarm transmission system that is activated by body movement not easily detected by an observer and not normally restricted by physical means or duress. It is an object to provide such means that both warns a user of the initiation of the signal activation sequence and permits interruption thereof and resetting, while not unduly delaying the signal activation when the initiation was intentional. It is an object to provide such a means including a warning mechanism that could not normally go unnoticed by the user. These and other objects of the invention are described in more detail below.

DISCLOSURE OF THE INVENTION

The present invention provides a circuit interception switch for an emergency alarm transmission system, and an emergency alarm transmission system including such circuit interception switch, normally interposed during use between an alarm activating switch and a radio transmitter or other means for transmitting a signal to a remote receptor, which is activated in its first mode by a first closure of the alarm activating switch to power an electric vibrator, and is activated in its second mode by a second closure of the alarm activating switch to open the circuit to the vibrator and close the circuit to the transmitter energizing the transmitter initiating signal transmission. The sequence required for signal transmission is two successive closures of the alarm activating switch which preferably would occur upon two successive body movements of the type normally difficult to detect or to restrict by a person in the proximity of the user. If the user intends to initiate signal transmission, such two successive body movements can be performed in rapid succession and hence there is but momentary delay between the first such body movement and transmitter activation. If the user had some how unintentionally moved in a manner to close the alarm activating switch once, not only would the user be made aware of such occurrence by the vibrator activation, the circuit interception switch could then be set back to its original position requiring then again two successive alarm activating switch closures for transmitter energization.

The circuit interception switch of the present invention, requiring two successive closures of the alarm activating switch without resetting therebetween to energize the transmitter, both provides a warning means and unlimited time for resetting upon unintentional closure of the alarm activating switch and provides a means for energizing the transmitter within a moment or fraction thereof of the first alarm activating switch movement. The alarm activating switch preferably is one held normally open, which closes upon a certain generally undetectable body movement and returns automatically to the open position immediately upon the ceasing of such body movement. These and other advantages of the present invention are described in more detail below.

PREFERRED EMBODIMENTS OF THE INVENTION

Figure 1:
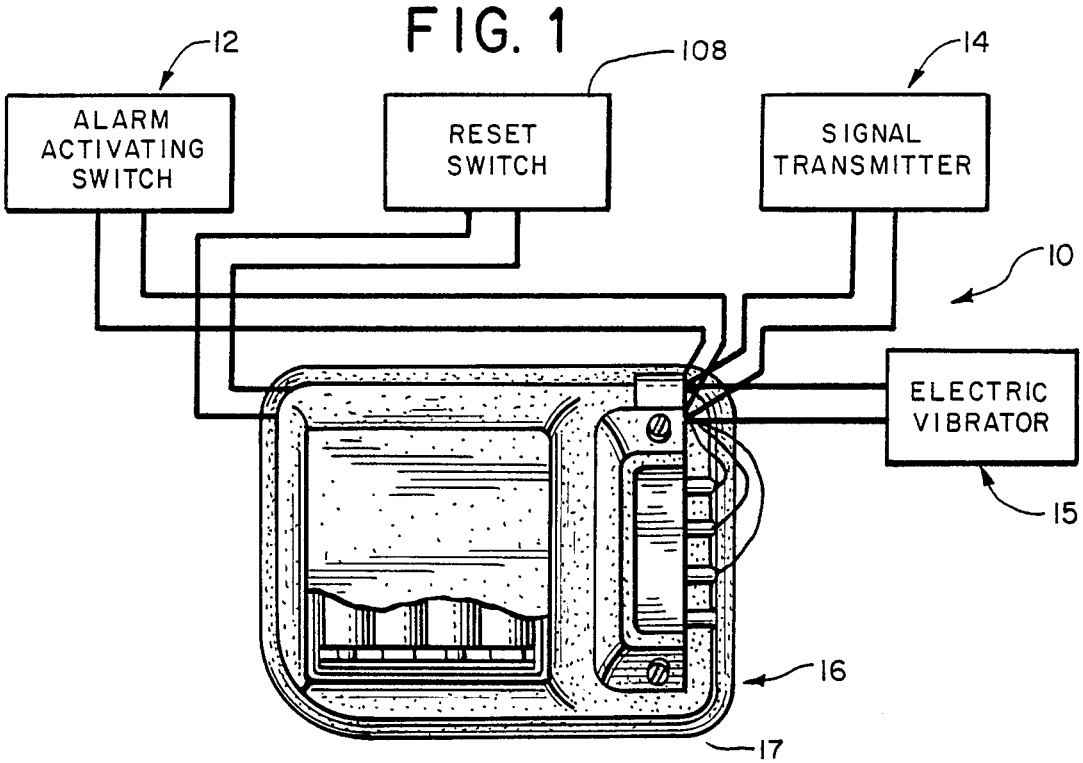
FIG. 1 is a plan view of an emergency alarm activation system embodying features of the present invention and wherein certain components are shown diagrammatically.

Referring now to the drawings, particularly to FIG. 1, there is shown an emergency alarm transmission system, designated generally by the reference numeral 10. The emergency alarm transmission system 10 is comprised of an alarm activating switch 12 (shown diagrammatically), a signal transmitter 14 (shown diagrammatically), and a circuit interception switch 16 interposed therebetween.

The alarm activating switch 12 and the signal transmitter 12 are preferably of the type described in U.S. Pat. No. 4,227,189, issued Oct. 7, 1980, to the inventor hereof and the disclosures and descriptions of that patent are incorporated hereinto by reference. As described in that patent, such an alarm activating switch 12 could be one mounted to and worn behind a belt or the like, and in which an electric circuit is closed by a contraction of the body's stomach muscles. Such an alarm activating switch 12 could include a normally open circuit (or off switch) held in the open (or off) position by outward pressure from the body. Stomach muscle contraction removes such outward pressure allowing pressure means, such as springs or the like, to move one electric contact to a second electric contact closing an electric circuit. In a preferred embodiment hereof, the alarm activating switch 12 is a means providing successive closures of an electric circuit upon successive body movements, which body movements are of a type not readily detectable nor restrictable by persons in the proximity of the user.

The signal transmitter 14 is any means, such as a radio transmitter, for transmitting a signal, preferably a signal that is undetectable by normal bodily senses in the area of the transmission, to a remote receptor, and in the present invention such signal transmitter 14 will be activated by closure of an electric circuit.

As shown in FIG. 1, the circuit interception switch 16 includes an outer housing 17 in which are mounted its various components (not shown in FIG. 1) which are discussed in detail below. Mounted on the outer surface of the housing 17 are a plurality of dry cell batteries 24 or other sources of electric current. The circuit interception switch 16, by separate circuits, is connected in series with both the alarm activating switch 12 and the signal transmitter 14, and there is no electric connection between the alarm activating switch 12 and the signal transmitter 14 except through the circuit interception switch 16. Also shown on FIG. 1 is an electric vibrator 15, a means for warning the user as will be described in more detail below.

Figure 2:
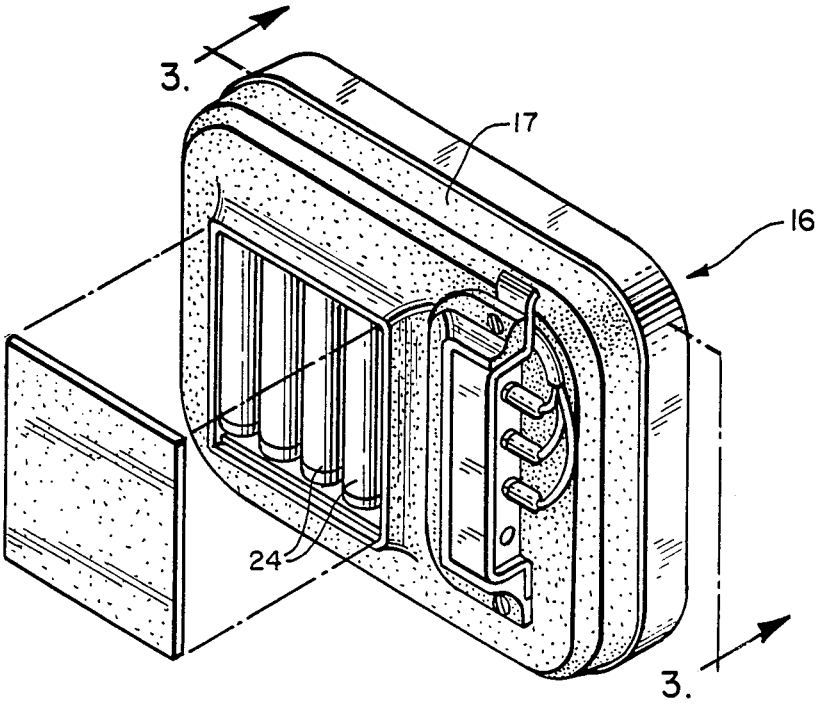
FIG. 2 is a partially exploded perspective view of a circuit interception switch embodying features of the present invention.
Figure 3:
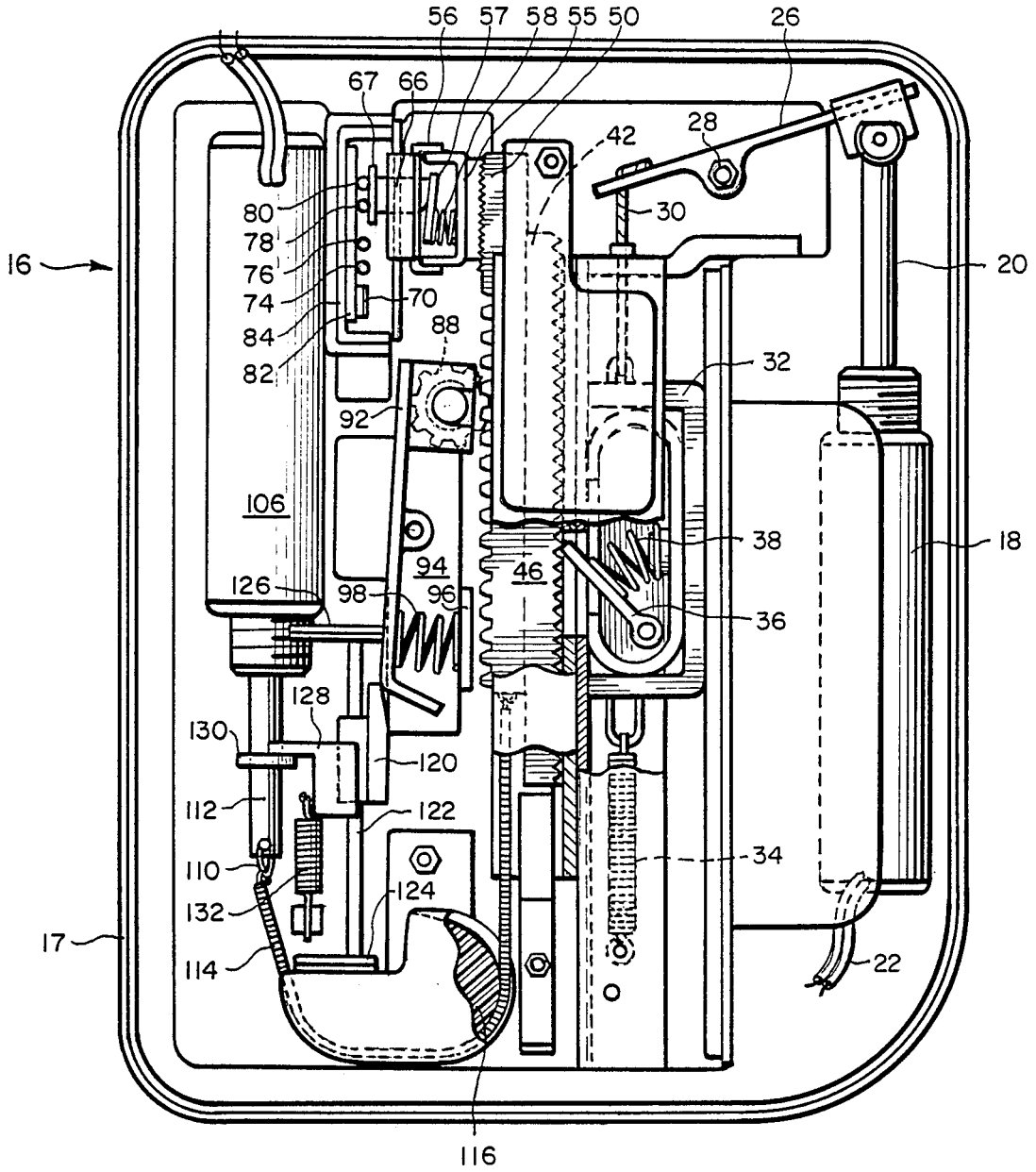
FIG. 3 is a cross-sectional plan view of the circuit interception switch of FIG. 2, taken along line 3 of FIG. 2.

Referring now also to FIG. 2 and FIG. 3, the circuit interception switch, 16 includes a first solenoid 18 which is connected in series with the alarm activating switch 12 and at least one of the batteries 24 which provides electric current to the circuit. The first solenoid 18 has a movable core 20 that retracts into the body of first solenoid 18 upon closure of the circuit by closure of the alarm activating switch 12. The movable core 20 is connected at its remote free end to one end of an advancing lever arm 26. The advancing lever arm 26 is pivotally mounted at a position between its two ends on a pivot shaft 28. The other end of the advancing lever arm 26 is connected to a ratchet gear driver 32 through a tie 30. The ratchet gear driver 32 is disposed generally parallel to the first solenoid 18. Upon closure of the alarm activating switch 12 the circuit to the first solenoid 18 is energized and its movable core 20 retracts into its body pulling the connected end of the advancing lever arm 26 downward and hence the ratchet gear driver 32 upward. The references herein to downward and upward are taken from the perspective of the free end of the movable core 20 of the first solenoid 18 being up or upward when the circuit to the first solenoid 18 is not energized and hence the movable core 20 is disposed extended away from the body of the first solenoid 18.

The ratchet gear driver 32 is biased against such upward movement by a driver spring 34 connected at one end to the ratchet gear driver 32 opposite the tie 30, and at the other end mounted stationarily, preferably to the housing 17. Hence the force pulling the ratchet gear driver 32 upward must be sufficient to override such spring bias, while the spring bias provided by the driver spring 34 should be sufficient to prevent upward movement of the ratchet gear driver 32 by mischance, such as by gravitational force or jarring of the circuit interception switch 16 or the like.

Housed within the ratchet gear driver 32 (or mounted thereon) is a gear catch or pawl 36 biased in a forward or upward direction by a pawl spring 38. Adjacent the ratchet gear driver 32 and its gear pawl 36 is a ratchet gear shaft, designated generally by the reference numeral 40, comprising an advancing ratchet 42 with ratchet teeth 44 along its outer side, a locking gear 46 with locking gear teeth 48 along its outer side, and a switch adjustment gear 50 with switch adjustment teeth 52 along its outer side. The advancing ratchet 42, the locking gear 46, and the switch shaft 40, or separate components bonded or otherwise interconnected. In any event, the ratchet teeth 44 of the advancing ratchet 42 are disposed immediately adjacent the ratchet gear driver 32 and its gear pawl 34, while the locking gear teeth 48 of the locking gear 46 and the switch adjustment teeth of the switch adjustment gear 50 are disposed on the opposite side of the ratchet gear shaft 40. As shown in FIG. 3, the switch adjustment gear 50 is positioned forward or upward of the locking gear 42.

The gear pawl 36 of the ratchet gear driver 32 is biased against the ratchet teeth 44 of the advancing ratchet gear 44. The ratchet gear shaft 40 is slidably mounted and hence upward or forward movement of the ratchet gear driver 32 is translated to the ratchet gear shaft 40, moving it and all of its components, including the switch adjustment gear 50, upward or forward.

Figure 4:
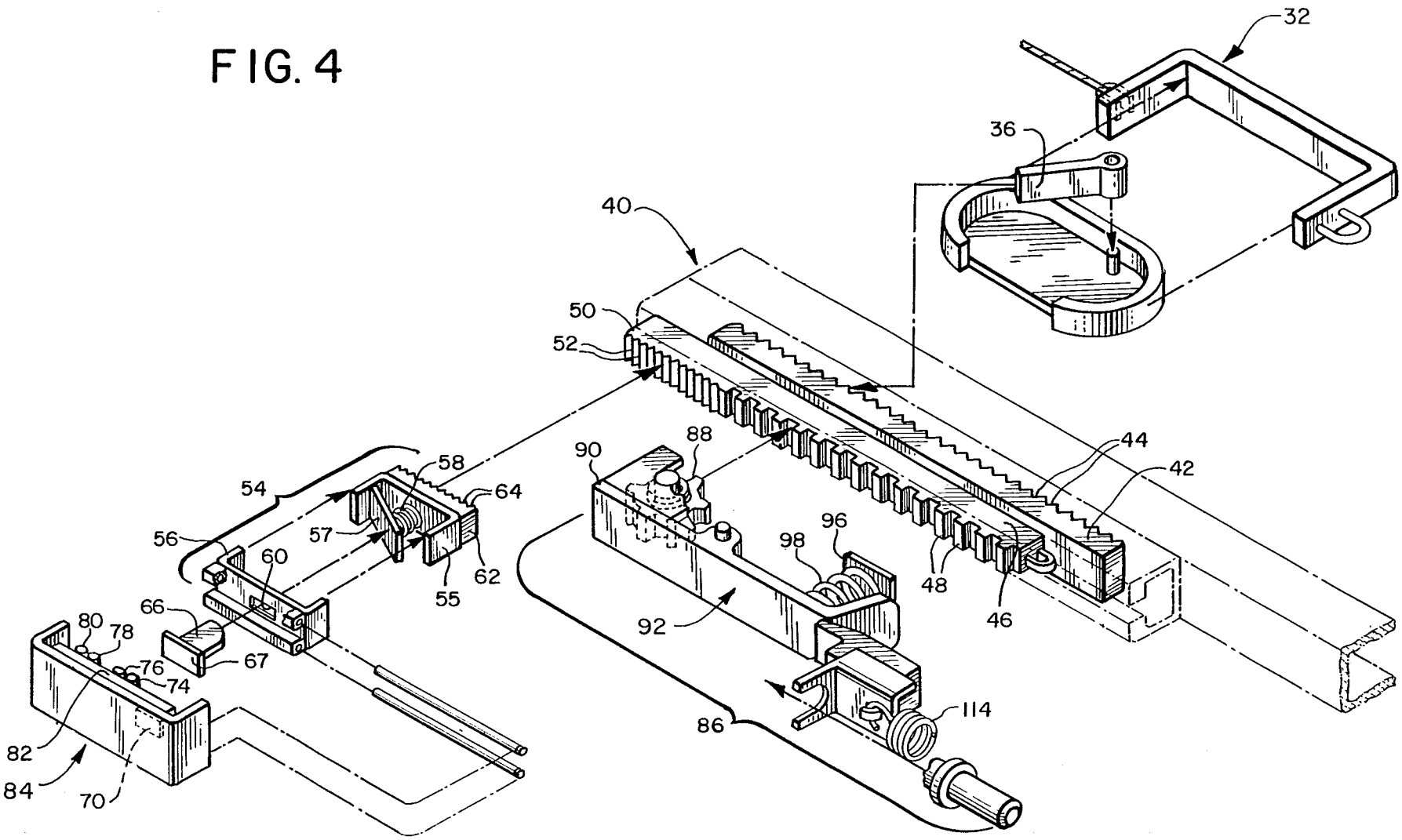
FIG. 4 is an exploded view of a portion of the circuit interception switch shown in FIGS. 2 and 3.

Referring now also to FIG. 4, there is shown a slide switch, designated generally by the reference numeral 54, comprising a second switch adjustment gear 62 having second switch adjustment teeth 64 and a contact foot 66 mounted opposite the second switch adjustment teeth 64. The second gear adjustment teeth 64 are intermeshed with the first switch adjustment teeth 52 whereby movement of the ratchet gear shaft 40 is translated to the second switch adjustment gear 62 and hence to the contact foot 66.

In more detail, the slide-switch 54 as shown in FIG. 3 and FIG. 4 includes a first and a second U-shaped housing frames 55,56 disposed one received within the other to form a four-sided frame surrounding a contact foot plate 57 connected to the inner surface of the first housing frame 55 by a plate spring 58. The plate spring 58 is connected to the contact for plate 57 to one side of its center. The contact foot plate 57 bears against the contact foot 66 which, as shown best in FIG. 4, extends partially through an aperture 60 in the second housing frame 56 into the four-side frame formed by the first and second housing frames 55,56. The contact foot 66 meets the contact foot plate 57 to one side of its center opposite the plate spring 58 so that the contact foot plate 57 is positioned on an angle bearing against a curved shoulder of the contact foot 66. The bottom-portion of the contact foot 66 is formed as a contact plate 67 and is of sufficient dimensions that it cannot pass through the aperture 60.

Adjacent the contact plate 67 of the contact foot 66 are a series of electrical leads stationarily mounted on a mounting base 82 which in turn is stationarily mounted within a lead housing 84. The uppermost or forward most set of leads are a first and second transmitter leads 78,80 and in FIG. 3 the contact plate 67 of the contact foot 66 is shown in its third position bridging these transmitter leads 78,80 as will be described in more detail below. Behind or below the transmitter leads 78,80 are a first and second vibrator leads 74,76, and behind or below these vibrator leads 74,76 is an upraised neutral platform 70. Upon resetting of the circuit interception switch 16 to its initial position (discussed in more detail below), the contact plate 67 of the contact foot 66 would be positioned adjacent the neutral platform 70 and pressed there against by the pressure exerted by the plate spring 58 against the contact foot plate 57 which in turn presses against the contact foot 66. Upon a single closure of the alarm activating switch 12 and concommitant energization of the first solenoid 18, the slide switch 54, having its second switch adjustment teeth 64 intermeshed with the first switch adjustment teeth 52 of the ratchet gear shaft 40, moves upward or forward with the ratchet gear shaft 40 a predetermined distance which is the distance required to move the contact plate 67 from the neutral platform 70 to a position bridging the first and second vibrator leads 74,76, closing an electric circuit to the vibrator 15 whereby the vibrator 15 is activated. Preferably the vibrator 15 is not mounted on a belt as is the alarm activating switch 12 but instead strapped or otherwise mounted directly against the body of the user, whereby the vibration sensation could not normally go unnoticed. A second closure of the alarm activating switch 12 without resetting the circuit interception switch 16 will move the contact plate 67 from the vibrator leads 74,76 to a position bridging the first and second transmitter leads 78,80, whereby the circuit to the vibrator 15 is opened and the circuit to the transmitter 14 is closed and the transmitter 14 is activated and commences signal transmission.

The circuit interception switch 16 further includes a gear shaft locking device, designated generally by the reference numeral 86, comprising a locking wheel 88 rotatably mounted on a shoulder 90 of a locking lever arm 92, a locking mounting base 94 on which the locking lever arm 92 is pivotably mounted, a spring stop 96 extending from the locking mounting base 94 and disposed adjacent the locking gear 46, a locking spring 98 mounted on the locking lever arm 92 opposite the locking wheel 88 and biased against the spring stop 96. When the locking spring 98 is allowed to stretch sufficiently, it rotates the locking lever arm 92 to a position whereat the locking wheel 88 intermeshes with the teeth 48 of the locking gear 46. Adjacent the locking wheel 88 is a locking wheel spring 89 interconnected thereto biasing the locking wheel 88 against clock-wise rotation while permitting counterclockwise rotation. When the locking wheel 88 is intermeshed with the teeth 48 of the locking gear 46, the locking gear 48 is prevented from movement downward or rearward. The rear of the locking gear 46 is interconnected to a release spring 110 normally providing at least some resistance to the movement of the locking gear 46 forward or upward. Hence when the locking gear 88 is intermeshed with the teeth 48 of the locking gear 46, the locking gear 46 is effectively locked against sliding movement, as is the forward switch adjustment gear 50.

Mounted within the housing 17 of the circuit interception switch 16, opposite the first solenoid 18, is a second solenoid 106 disposed approximately parallel to the first solenoid 18 but extending in opposite direction. The second solenoid 106 is connected in series with a manually operated, normally open, reset switch 108 and at least one of the batteries 24 which provide electric current to the circuit to the second solenoid 106 upon manual closure of the reset switch 108. This second solenoid 106 has a movable core 112 that retracts into the body of the second solenoid 106 upon closure of the reset switch 108.

The release spring 110, which as mentioned above is connected at one end to the rear or bottom of the locking gear 46, is stretched around a grooved release spring guide 116, and held within the groove thereof. The release spring 110 is connected at its opposite end to the free end of the core 112 of the second solenoid 106 whereby on activation of the second solenoid 106 the release spring 110 is stretched and creates a pulling force upon the locking gear 46 in the downward or rearward direction.

The circuit interception switch 16 further includes a release wedge foot 120 slidably mounted on a release wedge slide 122 (shown as comprising two parallel prongs) mounted between a first and second slide mounting plates 124,126. The first slide mounting plate 124 is disposed adjacent to release spring guide 116 opposite the release spring 110, while the second slide mounting plate 126 is disposed adjacent and between the shoulder of the second solenoid 106 and the locking lever arm 92 opposite and slightly forward or upward of the locking spring 98. Opposite and interconnected to the release wedge foot 120 is a release wedge catch 128 that slides upon the release wedge slide 122 together with the release wedge foot 120. Around the movable core 112 of the second solenoid 106 is mounted a collar 130. The collar 130 is of sufficient dimensions and the release wedge catch 128 is so positioned that the release wedge catch 128 is in the path of the collar 130 when the movable core 112 retracts into the body of the second solenoid 106, whereupon the collar 130 bears against the release wedge catch 128, sliding it and the interconnected release wedge foot 120 upward or forward along the release wedge slide 122. Upon such forward sliding, the release wedge foot 120 overrides the rear end of the locking lever arm 92 compressing the locking spring 98 against the spring stop 96, which in turn pivots the locking lever arm 92 into a position releasing the locking wheel 88 from the locking gear 46.

Hence the energization of the second solenoid 106 both releases the locking gear 46 for downward or rearward movement and provides the pulling force for such downward movement through the stretching of the release spring 110. Upon such downward or rearward movement of the locking gear 46 the interconnected switch adjustment gear 50 and intermeshed slide switch 54 is moved down also to a position at which the contact foot 66 is adjacent the neutral platform 70 and both the circuits to the transmitter 14 and the vibrator are left open.

The release wedge catch 128 is interconnected to a release wedge return spring 132 which slides it and the release wedge foot 120 to a position away from the locking lever arm 92 when the collar 130 no longer bears upon it upon extension of the core 120 of the second solenoid 106, releasing the locking spring 98.

Therefore when the alarm activating switch 12 is closed for the first time, the first solenoid 18 is activated causing the contact foot 57 to be advanced to a position bridging the first and second vibrator leads 74,76, closing the circuit to the vibrator which warns the user that the first of the two required alarm activating switch 12 closures has occurred. If this closure was intentional, the user will quickly cause a second closure of the alarm activating switch 12, energizing the first solenoid 18 a second time and advancing the contact foot 57 to a position bridging the first and second transmitter leads 78,80, closing the circuit to the transmitter 14, whereby the emergency signal is sent to a remote receptor. If instead the first closure was accidental or the user decides no signal should be transmitted, the vibrator warns the user of the first closure and the user can reset the circuit interception switch 16 by the manual closure of the reset switch 108 which energizes the second solenoid 106.

The reset switch 108 may be of the small magnetic type, commercially available, which can simply be carried in the user's pocket and closed by a hand held magnet or a magnet worn on a ring or the like. Such a reset switch 108 would of course be a normally open switch, closed when a magnet in the vicinity draws one metal element to the other. While resetting may often be done at times of no disturbance or other threat, it remains advantageous even for the resetting operation to be conducted in a manner unobvious to observers.

INDUSTRIAL APPLICABILITY OF THE INVENTION

The present invention is applicable to the security industry and all industries desiring security services.

I claim:

1. A circuit interception switch for an emergency alarm transmission system comprising:

a normally open first electric circuit;

an electric vibrator;

means to energize said electric vibrator upon a closure of said first electric circuit;

a normally open second electric circuit; and means to close said second electric circuit and concomitantly deenergize said electric vibrator upon a closure of said first electric circuit while said electric vibrator is energized.

2. The circuit interception switch of claim 1 further including means to deenergize said electric vibrator without closure of said first electric circuit.

3. The circuit interception switch of claim 2 wherein said electric vibrator energizing means comprises a normally open vibrator electric circuit having first and second vibrator leads, said first and second vibrator leads mounted spaced apart;

a slide switch having a contact plate;

an energy source for said vibrator electric circuit; and means for translating said slide switch from a position remote from said first and second vibrator leads to a position whereat said contact plate of said slide switch contacts and bridges said first and second vibrator leads and in said position closes said vibrator electric circuit.

4. The circuit interception switch of claim 3 wherein said second electric circuit closing means comprises, a first and second transmitter leads, said first and second transmitter leads mounted spaced apart and within said second electric circuit;

means for translating said slide switch from a position remote from said first and second transmitter leads to a position whereat said contact plate of said slide switch contacts and bridges said first and second transmitter leads and in said position closes said second electric circuit.

5. The circuit interception switch of claim 4 wherein said electric vibrator energizing means and said second electric circuit closing means are mounted within a housing.

6. The circuit interception switch of claim 5 wherein said means for translating said slide switch from a position remote from said first and second vibrator leads to a position whereat said contact plate of said slide switch contacts and bridges said first and second vibrator leads comprises, a first solenoid connected in electric series with said first electric circuit and having an energy source for said first electric circuit;

said first solenoid having a moveable core that retracts from a position outside the body of said first solenoid into said body upon closure of said first electric circuit;

an advancing lever arm mounted pivotally in said housing, said advancing lever arm being connected at one end to said core of said first solenoid, and at the other end to a ratchet gear driver through a tie, whereby upon retraction of said core of said first solenoid, said ratchet gear driver is pulled in a direction opposite said core;

means to bias said ratchet gear driver against said opposite movement, which biasing means is overcome by the pull of said advancing lever arm;

a ratchet gear shaft having a switch adjustment gear;

means interconnecting said switch adjustment gear to said slide switch; and gear shaft locking element preventing said contact plate from movement away from said first and second vibrator leads.

7. The circuit interception switch of claim 6 wherein said means for translating said slide switch from a position remote from said first and second transmitter leads to a position whereat said contact plate of said slide switch contacts and bridges said first and second transmitter leads comprises, said first solenoid;

said advancing lever arm and ratchet gear driver;

said ratchet gear driver biasing means;

said switch adjustment gear;

said ratchet gear moving means;

said means interconnecting said switch adjustment gear to said slide switch; and means preventing said contact plate from movement away from said first and second vibrator leads.

8. The circuit interception switch of claim 7 further including a neutral platform mounted on said housing wherein said neutral platform is disposed adjacent said first and second vibrator leads, and said first and second transmitter leads are disposed adjacent said first and second vibrator leads opposite said neutral platform, and wherein said gear shaft locking element preventing said contact plate from movement away from said first and second vibrator leads and said means for preventing said contact plate from movement away from said first and second vibrator leads comprises, a toothed gear shaft locking wheel rotatably mounted on a shoulder of a locking lever arm, said locking lever arm being pivotally mounted on said housing adjacent a locking gear, said locking gear being mounted on said ratchet gear shaft and moveable therewith;

a locking spring connected to said locking lever arm opposite said locking wheel and biasing said locking lever arm to a position whereat said locking wheel is intermeshed with said locking gear; and a locking wheel spring interconnected to said locking wheel biasing said locking wheel against movement in the direction of said first solenoid core when retracting into said solenoid body.

9. The circuit interception switch of claim 8 wherein said means to deenergize said electric vibrator without closure of said first electric circuit comprises, a second solenoid having a moveable core that retracts from a position outside the body of said second solenoid into said body upon energization;

a reset electric circuit, reset switch, and energy source for said reset electric circuit wherein said reset switch and second solenoid are connected in electric series;

said reset electric circuit being normally open and closed by closure of said reset switch, whereupon said core of said second solenoid retracts into the body of said second solenoid;

a release spring connected at one end to said core of said second solenoid and at the other end to said locking gear;

said release spring being extended about a guide so as to exert biasing force against both said core of said second solenoid and said locking gear in the same direction; and means to release said locking wheel from said locking arm upon retraction of said core of said second solenoid, whereby upon contraction of said core of said second solenoid said release spring translates said ratchet gear shaft to a position whereat said contact plate of said slide switch is disposed remote from said vibrator leads and transmitter leads and adjacent said neutral platform.

10. The circuit interception switch of claim 9 wherein locking wheel releasing means comprises, a release wedge foot slidably mounted between a first and second slide mounting plates;

said first slide mounting plate being disposed adjacent said release spring guide opposite said release spring;

said second slide mounting plate being disposed between said second solenoid and said locking lever arm opposite said locking spring;

a release wedge catch interconnected to said release wedge foot and moveable therewith;

a collar mounted on said core of said second solenoid;

said collar having sufficient dimension that said release wedge catch is disposed within the path of said collar when said core of said second solenoid retracts, whereupon said collar bears against said release wedge catch, sliding said release wedge catch and said release wedge foot towards said second slide mounting plate whereat said release wedge foot bears against said locking lever arm pivoting said locking lever arm to a position whereat said locking wheel is released from said locking gear.

11. An alarm transmission system comprising, a normally open alarm activating switch;

a signal transmitter; and a circuit interception switch comprising:

a normally open first electric circuit closed by said alarm activating switch;

an electric vibrator;

means to energize said electric vibrator upon a closure of said first electric circuit;

a normally open second electric circuit connected to said signal transmitter;

means to close said second electric circuit and concomitantly deenergize said electric vibrator upon closure of said first electric circuit while said electric vibrator is energized.

12. The alarm transmission system of claim 11 further including means to deenergize said electric vibrator without closure of said first electric circuit.

13. The alarm transmission system of claim 12 wherein said alarm activating switch is comprised of means for providing successive closures of said first electric circuit upon successive body movements of the user.

14. The alarm transmission system of claim 13 wherein said electric vibrator energizing means comprises a normally open vibrator electric circuit having first and second vibrator leads, said first and second vibrator leads mounted spaced apart;

a slide switch having a contact plate;

an energy source for said vibrator electric circuit; and means for translating said slide switch from a position remote from said first and second vibrator leads to a position whereat said contact plate of said slide switch contacts and bridges said first and second vibrator leads and in said position closes said vibrator electric circuit.

15. The alarm transmission system of claim 14 wherein said second electric circuit closing means comprises, a first and second transmitter leads, said first and second transmitter leads mounted spaced apart and within said second electric circuit;

means for translating said slide switch from a position remote from said first and second transmitter leads to a position whereat said contact plate of said slide switch contacts and bridges said first and second transmitter leads and in said position closes said second electric circuit and energizes sais signal transmitter.

16. The alarm transmission system of claim 15 wherein said electric vibrator energizing means and said second electric circuit closing means are mounted within a housing.

17. The alarm transmission system of claim 16 wherein said means for translating said slide switch from a position remote from said first and second vibrator leads to a position whereat said contact plate of said slide switch contacts and bridges said first and second vibrator leads comprises, a first solenoid connected in electric series with said first electric circuit and having an energy source for said first electric circuit;

said first solenoid having a moveable core that retracts from a position outside the body of said first solenoid into said body upon closure of said first electric circuit;

an advancing lever arm mounted pivotally in said housing, said advancing lever arm being connected at one end to said core of said first solenoid, and at the other end to a ratchet gear driver through a tie, whereby upon retraction of said core of said first solenoid, said ratchet gear driver is pulled in a direction opposite said core;

means to bias said ratchet gear driver against said opposite movement, which biasing means is overcome by the pull of said advancing lever arm;

a ratchet ear shaft having a switch adjustment gear;

means interconnected to said ratchet gear driver to move said ratchet gear with the movement of said ratchet gear driver;

means interconnecting said switch adjustment gear to said slide switch; and gear shaft locking element preventing said contact plate from movement away from said first and second vibrator leads.

18. The alarm transmission system of claim 17 wherein said means for translating said slide switch from a position remote from said first and second transmitter leads to a position whereat said contact plate of said slide switch contacts and bridges said first and second transmitter lead comprises, said first solenoid;

said advancing lever arm and ratchet gear driver;

said ratchet gear driver biasing means;

said switch adjustment gear;

said ratchet gear moving means;

said means interconnecting said switch adjustment gear to said slide switch; and means preventing said contact plate from movement away from said first and second vibrator leads.

19. The alarm transmission system of claim 18 further including a neutral platform mounted on said housing wherein said neutral platform is disposed adjacent said first and second vibrator leads, and said first and second transmitter leads are disposed adjacent said first and second vibrator leads opposite said neutral platform, and wherein said gear shaft locking element preventing said contact plate from movement away from said first and second vibrator leads and said means for preventing said contact plate from movement away from said first and second vibrator leads comprises, a toothed gear shaft locking wheel rotatably mounted on a shoulder of a locking lever arm, said locking lever arm being pivotally mounted on said housing adjacent a locking gear, said locking gear being mounted on said ratchet gear shaft and moveable therewith;

a locking spring connected to said locking lever arm opposite said locking wheel and biasing said locking lever arm to a position whereat said locking wheel is intermeshed with said locking gear; and a locking wheel spring interconnected to said locking wheel biasing said locking wheel against movement in the direction of said first solenoid core when retracting into said solenoid body.

20. The alarm transmission system of claim 19 wherein said means to deenergize said electric vibrator without closure of said first electric circuit comprises, a second solenoid having a moveable core that retracts from a position outside the body of said second solenoid into said body upon energization;

a reset electric circuit, reset switch, and energy source for said reset electric circuit wherein said reset switch and second solenoid are connected in electric series;

said reset electric circuit being normally open and closed by closure of said reset switch, whereupon said core of said second solenoid retracts into the body of said second solenoid;

a release spring connected at one end to said core of said second solenoid and at the other end to said locking gear;

said release spring being extended about a guide so as to exert biasing force against both said core of said second solenoid and said locking gear in the same direction; and means to release said locking wheel from said locking arm upon retraction of said core of said second solenoid, whereby upon contraction of said core of said second solenoid said release spring translates said ratchet gear shaft to a position whereat said contact plate of said slide switch is disposed remote from said vibrator leads and transmitter leads and adjacent said neutral platform.

21. The alarm transmission system of claim 20 wherein locking wheel releasing means comprises, a release wedge foot slidably mounted between a first and second slide mounting plates;

said first slide mounting plate being disposed adjacent said release spring guide opposite said release spring;

said second slide mounting plate being disposed between said second solenoid and said locking lever arm opposite said locking spring;

a release wedge catch interconnected to said release wedge foot and moveable therewith;

a collar mounted on said core of said second solenoid;

said collar having sufficient dimension that said release wedge catch is disposed within the path of said collar when said core of said second solenoid retracts, whereupon said collar bears against said release wedge catch, sliding said release wedge catch and said release wedge foot towards said second slide mounting plate whereat said release wedge foot bears against said locking lever arm pivoting said locking lever arm to a position whereat said locking wheel is released from said locking gear.

* * * * *